US006572469B2

(12) United States Patent
Klitsner et al.

(10) Patent No.: US 6,572,469 B2
(45) Date of Patent: Jun. 3, 2003

(54) ELECTRONIC TIC-TAC-TOE GAME HAVING THREE FUNCTION CONTROL

(75) Inventors: Daniel B. Klitsner, Larkspur, CA (US); Brian P. Clemens, San Francisco, CA (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 09/779,166

(22) Filed: Feb. 8, 2001

(65) Prior Publication Data

US 2002/0107061 A1 Aug. 8, 2002

(51) Int. Cl.[7] ..... A63F 9/24; A63F 3/06

(52) U.S. Cl. ..... 463/9; 273/271

(58) Field of Search ..... 463/1–3, 7, 9, 463/30–31, 35, 37–38, 43–44, 46–47, 64; 273/143 R, 153 S, 153 R, 236–237, 264, 271, 281, 287; 200/5 A, 5 D, 5 R, 6 A, 9, 13–14, 175–176

(56) References Cited

U.S. PATENT DOCUMENTS 4,184,676 A * 1/1980 Barish ..... 273/237
4,275,442 A 6/1981 Underwood et al.
4,346,892 A 8/1982 Kitchen et al.
4,418,917 A * 12/1983 Jalali et al. ..... 463/2
4,813,681 A 3/1989 Volpert, Jr.
4,863,172 A 9/1989 Rosenwinkel et al.
5,536,911 A * 7/1996 Madill ..... 200/6 A
5,655,773 A 8/1997 Marks
5,743,796 A 4/1998 Orak et al.
5,855,513 A 1/1999 Lam
5,927,714 A 7/1999 Kaplan
6,042,117 A * 3/2000 O'Brien ..... 273/281

* cited by examiner

*Primary Examiner*—Kim Nguyen
(74) *Attorney, Agent, or Firm*—Roy A. Ekstrand

(57) ABSTRACT

A game apparatus includes a housing supporting a three by three grid of tic-tac-toe game play squares. The housing further supports a pivotable multi-function launch control which provides three game function inputs to the game microprocessor. The display further includes a trio of paths for each of the three columns in the tic-tac-toe square array. The game simulates launch of a game object down one of the paths selected by pivotal movement of the launch control to attempt marking a particular square in the tic-tac-toe array. The launch control includes a depressible launch button which performs a second function of setting game object launch power and a third function of triggering game object simulated launch.

3 Claims, 1 Drawing Sheet

108
73
74
75
80
106 107
105
81
109
70
71
72

11
60
61
38
62
101
90
91
83
93
96
94
97
92
58
57
102
82
39
87
63
100
95
64
66
65

114
113
111
112
115
11
84
91
92
90
81
66
59
80
88
89
15
12
110
13
3
4
50
51
56
57
58
52
55

20
14
40
23
26
43
30
34
41
31
21
32
2
22
42
25
24
28
27
33
12
13
11
10
63
64
65
54
52
53
60
50
61
51
62

ELECTRONIC TIC-TAC-TOE GAME HAVING THREE FUNCTION CONTROL

FIELD OF THE INVENTION

This invention relates generally to electronic games and particularly to those electronic games which are configured to play the game of tic-tac-toe.

BACKGROUND OF THE INVENTION

Tic-tac-toe is a well known game which is played by a broad range of players. The game is easy to learn and deceptively simple to play. Notwithstanding this ease of learning and simplicity of play, however, the game of tic-tac-toe can be extremely challenging to master. In its most pervasive form, the game of tic-tac-toe is played within a simple grid formed by perpendicular intersecting pairs of parallel lines to define a center square and eight adjacent outer "squares". Because of the simplicity of play and ease of drawing the play grid, tic-tac-toe is for the most part played with simple pencil and paper supplies. The game is typically played between two players, one of which utilizes a symbol such as an "X" while the other utilizes a different symbol such as an "O". The players alternate turns placing their respective symbols in selected ones of the nine squares within the grid. The objective of game play is the successful placement of symbols by one player to form a three row symbol pattern. The three row symbol patterns may include any three adjacent squares as well as either of the two diagonals of the grid. As each player places their respective symbols within the grid squares, a secondary objective must also be considered in symbol placement which involves "blocking" the opposing player from successfully achieving a winning three square combination.

In addition to its wide appeal as a game readily played with simple pencil and paper apparatus, the game of tic-tac-toe is also very well suited in its "move and countermove" play pattern for play against a computer by a single player. Upon this recognition, practitioners in the art began providing computerized or microprocessor based game play devices which included stored software having the necessary probability tables and move and countermove rules stored in memory. The typical game play unit further includes a display having the tic-tac-toe grid thereon together with an input device utilized by a player in game play. The software necessary for game play by the processor is readily manageable by even the smallest of software memories in that the processor simply responds to each player's move by computing the most effective countermove within the stored alternatives of game play.

In most computerized or microprocessor based tic-tac-toe games, an alternate two player mode in which players compete against each other is also usually provided.

As the popularity of computerized or microprocessor based tic-tac-toes increased, practitioners in the art have provided a virtually endless variety of game apparatus. Notsurprisingly, the complexity of this simple basic game has been enhanced with various features such as light, sound or other attractive enhancements. For example, U.S. Pat. No. 4,184,676 issued to Barish sets forth an ELECTRONIC TIC-TACK-TOE GAME having a pocket calculator type apparatus which includes a keyboard having a three-by-three matrix of keys each of which may be depressed once to input an "O" and twice to input an "X". The device further includes a matrix display for displaying the inputted "X's" and "O's" together with a mode selector for operating the device in various display modes.

U.S. Pat. No. 4,275,442 issued to Underwood, et al. sets forth an ELECTRONIC TIC-TAC-TOE GAME having a display board supporting a tic-tac-toe array thereon. The game controls the display of selected "X's" and "O's" on the display board. A game mode select switch enables the game to be played in a solitary mode of operation against a microprocessor programmed to play tic-tac-toe or in a dual mode of operation between two players.

U.S. Pat. No 4,813,681 issued to Volpert, Jr. sets forth a METHOD OF PLAYING AN ALIGNMENT GAME having a plurality of playing markers adapted to be arranged in rows and columns. The playing markers include four playing markers having a first indicia thereon, four playing markers having a second indicia thereon and a single playing marker having both a first and second indicia thereon.

U.S. Pat. No. 5,927,714 issued to Kaplan sets forth an INTERACTIVE TIC-TAC-TOE SLOT MACHINE having three parallel spaced reels each reel being covered around their circumference with spaced symbols of two different configurations such as "X's" and "O's" as well as blanks. The "X's" and "O's" and blanks are intermixed on each strip in an orderly fashion. Three of the same symbols aligned in a row designates a winner. The slot machine includes a window that displays three rows of symbols in different horizontal planes.

U.S. Pat. No. 5,655,773 issued to Marks sets forth a COMBINATION TIC-TAC-TOE GAME AND NUMBERED CARD COMPETITION which includes a game board divided into a plurality of zones arranged in a plurality of rows and columns as well as a plurality of diagonals. The game device also includes first and second sets of playing pieces respectively utilized by first and second players. At least three of the first and second sets of playing pieces are placed into at least three of the zones of the game board until at least three of the first or second playing pieces have been placed in a plurality of rows or diagonals.

U.S. Pat. No. 5,743,796 issued to Orak, et al. sets forth an ELECTRONIC GAME having a housing defining a plurality of spaces thereon. Each of the spaces has an input device and an indicator corresponding to the space. Each indicator defines an off state and a plurality of distinct player states. Within the housing, a controller communicates with each of the input devices and indicators and limits the number of indicators to a predetermined number.

In other related electronic games and game apparatus, different types of game apparatus have been provided. For example, U.S. Pat. No. 4,346,892 issued to Kitchen, et al. sets forth an ELECTRONIC POOL GAME having a matrix display supported upon a housing generally representative of a surface of a pool table. A control and driving circuit is provided for applying signals to the matrix display for the display of indicia representative of pool balls including a cue ball. The driving and control circuit is adapted for the selective application of further driving signals to the matrix display to represent a selected direction of travel, placement and orientation, and velocity for the travel of the cue ball.

U.S. Pat. No. 5,855,513 issued to Lam sets forth an ELECTRONIC MATCHING AND POSITIONING GAME having a housing with a plurality of spaces defined on the exterior thereof. Each of the spaces has an input device and an indicator associated therewith. The indicator defines an off state and an on state. Inside the housing a controller communicates with each of the input devices and indicators and controls game play operation.

U.S. Pat. No. 4,863,172 issued to Rosenwinkel, et al. sets forth a FRONT AND BACK GRIDS COMPRESSING PUZZLE WITH MOVABLE SQUARES in which alphabet letters or other graphics are displayed in movable squares forming a grid on the front side of the puzzle. A second grid of movable squares containing alphabet letters or other graphics is supported on the back side of the puzzle. Each square is a part of each of two mutually transverse continuous bands.

While the foregoing described prior art devices have to some extent advanced the art and have in some instances enjoyed commercial success, there remains nonetheless a continuing need in the art for evermore improved, interesting and entertaining electronic tic-tac-toe games and apparatus therefor.

SUMMARY OF THE INVENTION

Accordingly, it is a general object of the present invention to provide an improved electronic game. It is a more particular object of the present invention to provide an improved electronic game which is uniquely suitable for amusing operation in playing the game of tic-tac-toe.

In accordance with the present invention, there is provided an electronic tic-tac-toe game play apparatus comprising: a housing defining an interior cavity; a display, supported on the housing, defining a three row—three column matrix of squares and a trio of paths each joined to one of the columns; a microprocessor and memory for playing a tic-tac-toe game; a launch control supported on the housing and having a pivotable path selection ring, a launch button, a plate having a wiper contact and a switch board secured to the housing and supporting a plurality of conductive paths and a launch switch, the path selection ring, the launch button and the plate being pivotably movable upon the housing as a single assembly to select one of the paths and the launch button being depressible to close the switch and releasable to open the switch.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

Figure 1:
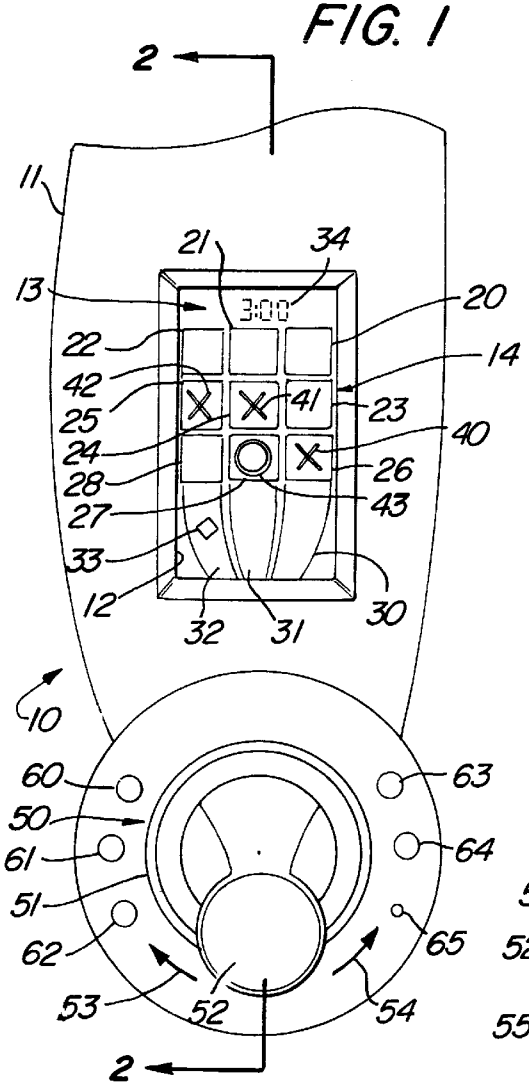
FIG. 1 sets forth a top view of an electronic tic-tac-toe game constructed in accordance with the present invention.

FIG. 1 sets forth a top view of a game apparatus constructed in accordance with the present invention and generally referenced by numeral 10. Game apparatus 10 includes a housing 11 which, as is better seen in FIG. 2, defines an interior cavity 15. Housing 11 further defines an aperture 12 within which a display unit 13 is supported. Display unit 13 is configured for play of tic-tac-toe and thus defines a grid 14 formed by a three by three matrix of squares 20 through 28. In addition, grid 14 further includes a trio of paths 30, 31 and 32 each extending upwardly to the bottom side of the right, center and left columns of grid 14. In depiction of a typical game play scenario, various "X" and "O" icons are showed placed upon grid 14. Thus, by way of example, square 26 supports an "X" icon 40 while squares 24 and 25 also support similar "X" icons 41 and 42. In contrast, square 27 supports an "O" icon 43. A bean bag icon 33 is shown within path 32. The use of bean bag icon 33 will be set forth below in greater detail. Suffice it to note here that the game play utilized by game apparatus 10 involves a simulated launch of a bean bag game object which is simulated upon display 13 by icons such as bean bag icon 33. Finally, display 13 further includes an alphanumeric segment group 34 which is used to communicate various game play information to the player or players such as time interval, score or game level selected.

In accordance with an important aspect of the present invention, game apparatus 10 includes a three function launch control 50 supported upon the lower end of housing 11 and having a path selector ring 51 supporting a depressible launch button 52. Also supported on housing 11 adjacent launch control 50 is a plurality of game play and setup buttons 60 through 65 which are utilized to make certain initialization and play mode selections particularly at the initiation or completion of a game. In the manner set forth below in greater detail, path selector ring 51 is movable along with launch button 52 in either direction as indicated by arrows 53 and 54. The point of having path selector 51 and launch button 52 pivotable in this manner is found in the selection of a single one of paths 30, 31 or 32 for launch of the simulated bean bag game object. Thus, for example, positioning of path selector ring 51 and launch button 52 in the centered position shown in FIG. 1 provides a selection of path 31 allowing the player to execute a game object launch upwardly through the column occupied by squares 27, 24 and 21. Alternatively, pivotal movement of path selector ring 51 and launch button 52 in the direction indicated by arrow 53 provides selection of path 30 for the launched game object allowing access to squares 26, 23 or 20. Finally, pivoting selector ring 51 and launch button 52 in the direction indicated by arrow 54 provides selection of path 32 which in turn provides access to squares 28, 25 and 22.

In operation, the basic game of tic-tac-toe is played upon grid 14 of display 13 in general accordance with the normal rules of game play. However, an additional skill requirement has been added to the basic tic-tac-toe game play of game apparatus 10 by the addition of launch control 50. Launch control 50 is a three function control which is utilized in adding a skill level to the placement of a player's icon upon an unoccupied square within grid 14. The three functions selected and controlled by launch control 50 include the selection of one of paths 30, 31 and 32 with the resulting selection of the right, center or left column of grid squares. The second function of launch control 50 is activated by pressing launch button 52 once selector ring 51 and launch button 52 have been pivoted to the desired selected path. The pressing of launch button 52 operates a switch (switch 81 seen in FIG. 2) which, as is described below in greater detail, initiates the preparation for the simulated launch of the bean bag game object. As launch button 52 is pressed, the launch power to be simulated in the launch of the bean bag game object along the selected path and column of squares is increased so long as launch button 52 remains pressed. The user attempts to exercise skill in selecting the desired launch power in order to control the "landing" point of the launched bean bag game object to the desired square. Once the desired launch power has been set, the third function of launch control 50 is implemented by releasing launch button 52 which, as is set forth below in greater detail, opens switch 81 (seen in FIG. 2). With launch button 52 released, further increase in launch power is terminated and the simulated launch of the game object is initiated. Thus, the players utilizing the present invention game apparatus are required to devise a correct game play strategy in accordance with conventional tic-tac-toe game play which is further complicated or challenged by the skill level required in actually successfully placing an icon upon the target square which the player decides to mark. It has been found that the use of a three function integrated control mechanism for launch control 50 renders the play pattern of the present invention game apparatus both enjoyable and amusing as well as challenging.

Figure 2:
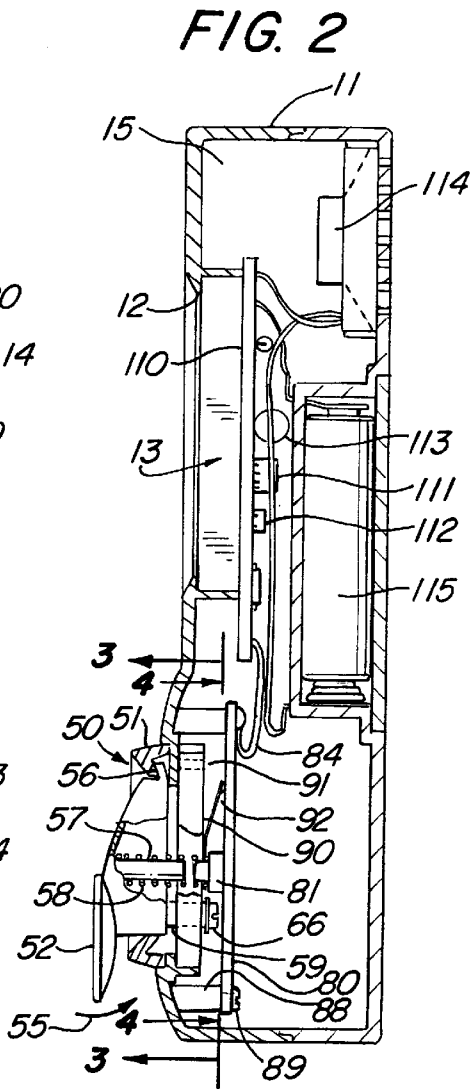
FIG. 2 sets forth a section view of the present invention electronic tic-tac-toe game taken along section lines 2—2 in FIG. 1.

FIG. 2 sets forth a section view of game apparatus 10 taken along section lines 2—2 in FIG. 1. As described above, game apparatus 10 includes a housing 11 defining an interior cavity 15. Housing 11 further defines an aperture 12 behind which a display unit 13 is supported to be visible therethrough. Housing 11 further supports a pivotable path selector ring 51 which in turn supports a launch button 52. A speaker 114 is supported within housing 11 together with a plurality of conventional batteries such as battery 115. A printed circuit board 110 is supported within housing 11 and provides a support base for display unit 13. In addition, printed circuit board 110 further supports a microprocessor integrated circuit 111 together with an associated memory 112. Additional digital electronic circuit components such as component 113 are also supported by circuit board 110. It will be understood that circuit board 110 is fabricated in accordance with conventional fabrication techniques and provides a plurality of electrical connections between the various components and circuit elements supported upon the circuit board to form an operative digital electronic microprocessor game playing circuit.

Housing 11 further supports a switch board 80, the structure of which is set forth below in FIG. 4 in greater detail. Suffice it to note here that switch board 80 is supported beneath path selector ring 51 and launch button 52 and includes a depressible switch 81. As is better seen in FIG. 4, switch board 81 further includes a plurality of additional switches 70 through 75 as well as a plurality of conductive pads 105, 106, 107 and 108.

Returning to FIG. 2, launch button 52 is secured in a pivotal attachment to ring 51 at a pivot 56. Launch button 52 further includes a post 57 extending downwardly toward switch 81 of switch board 80. A return spring 58 is received upon post 57 and the outer edge of switch 81 and provides a spring force urging launch button 52 upwardly to raise post 57 away from switch 81. The upward travel of launch button 52 produced by the force of spring 58 is limited by the combination of a post 59 extending downwardly from launch button 52 and passing through a slot 87 (seen in FIG. 3) formed in a plate 90 together with a fastener 66. Fastener 66 is larger than slot 87 and thus prevents the extensive upward pivoting movement of launch button 52 beyond the position shown.

Figure 3:
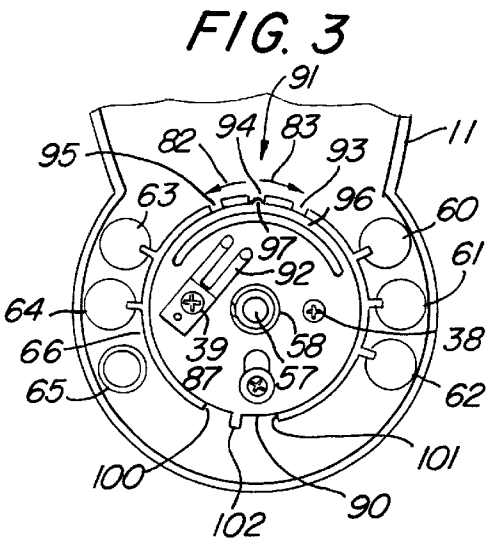
FIG. 3 sets forth a partial section view of the switch mechanism of the present invention electronic tic-tac-toe game taken along section lines 3—3 in FIG. 2.

Plate 90 is better seen in FIG. 3 and is supported beneath path selector ring 51 and is secured to selector ring 51 by a plurality of fasteners such as fasteners 38 and 39 (seen in FIG. 3). Thus, the combination of selector ring 51, launch button 52 and plate 90 are movable in a pivotal movement as a single unitary assembly.

In further accordance with the present invention, a wiper contact 92 preferably formed of a spring steel material is secured to the underside of plate 90 and extends downwardly to touch the upper surface of switch board 80. With temporary reference to FIG. 4, it will be noted that conductive pads 105 through 108 are positioned upon switch board 80 so as to be contacted by wiper contact 92.

Returning to FIG. 2, it will be understood by those skilled in the art that microprocessor 111 utilizes a stored instruction set within memory 112 to provide control of display 13 and to respond to input switch conditions from launch control 50. It will be further understood that the stored instruction set within memory 112 is utilized in providing the above-mentioned game play of tic-tac-toe. It will be noted that the normal raised position of launch button 52 is provided by the cooperation of spring 58, post 59 and fastener 66. The user exercises the above-described game play action by forcing launch button 52 downwardly in the direction indicated by arrow 55 overcoming the force of spring 58. As launch button 52 pivots downwardly against the force of spring 58, the lower end of post 57 contacts the depressible member of switch 81 actuating the switch and causing a signal input to microprocessor 111. In the desired game play described above, the result of the signal input from activation of switch 81 causes microprocessor 111 to sequentially and incrementally increase the power level to be applied to the launch of the simulated game object. Continuing with the above-described game play, the release of launch button 52 allows spring 58 to pivot launch button 52 upwardly until fastener 66 limits further upward travel. This upward pivotal movement withdraws the lower end of post 57 from switch 81 restoring switch 81 to an open condition. The return of the open condition of switch 81 provides a further signal input to microprocessor 111 which initiates the launch of the game object.

The pivotal movement of launch button 52 and path selector ring 51 together with plate 90 is subjected to a three position detent provided by detent mechanism 91. Detent mechanism 91 is better seen in FIG. 3. However, suffice it to note here that the use of a three position detent mechanism limits the pivoting position of launch control 50 to the three paths formed on display 13 (seen in FIG. 1). In addition and as is also better seen in FIG. 3, the pivoting movement of launch control 50 is further limited by a limit stop 102. This maintains the pivoting movement of launch control 50 within the desired three position range.

FIG. 3 sets forth a partial section view of launch control 50 taken along section lines 3—3 in FIG. 2. Of importance to observe in FIG. 3 is the provision of the above-mentioned three position detent mechanism (detent 91) as well as the travel limit function of limit stop 102.

More specifically, game 10 includes a housing 11 within which a plurality of game play buttons 60 through 65 are supported. Housing 11 further includes a generally cylindrical wall 66 which defines a pair of edges 100 and 101 together with a trio of detent slots 93, 94 and 95. A plate 90 is supported within wall 66 by a pair of fasteners 38 and 39 which secure plate 90 to path selector ring 51 (seen in FIG. 2). Plate 90 is thus pivotable about a post 57 and spring 58 which extend downwardly from launch button 52 (seen in FIG. 2). Plate 90 defines a limit stop 102 which prevents excessive pivotal movement of plate 90 by the cooperation of edges 100 and 101 of wall 66. Plate 90 further defines a slot 87 which receives post 59 (seen in FIG. 2) of launch button 52 and a fastener 89. A wiper contact 92 is secured to the underside of plate 90. Plate 90 further defines a detent spring portion 96 which resiliently supports a detent rib 97.

Detent rib 97 is resiliently received within detent slots 93, 94 or 95 to fix the position of plate 90 at one of three detented positions. Thus, plate 90 is pivotable from the centered detent position shown in FIG. 3 in the direction of arrow 83 to the detent position defined by slot 93 or, alternatively, pivotable in the direction indicated by arrow 82 to the detent position shown at slot 95.

It will be noted that wiper contact 92 forms a generally U-shaped structure known generally in the art as a "bridging contact". With temporary reference to FIG. 4, it will be noted that the two prongs of wiper contact 92 are in contact with conductive pad 105 in all three detent positions and are further in contact with one of conductive pads 106 through 108 depending upon the pivotal position of plate 90.

Figure 4:
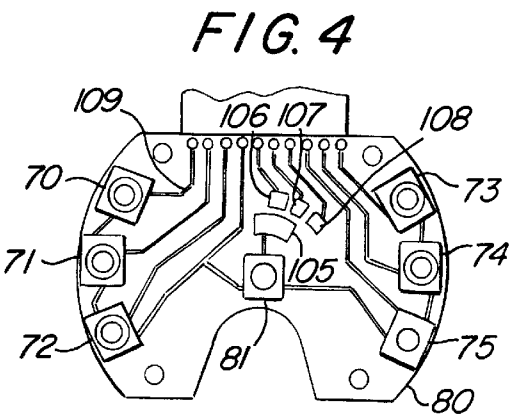
FIG. 4 sets forth a partial section view of the switch mechanism of the present invention electronic tic-tac-toe game taken along section lines 4—4 in FIG. 2.

FIG. 4 sets forth a partial section view of launch control 50 taken along section lines 4—4 in FIG. 2. Launch control 50 includes a switch board 80 supporting a switch 81 described above which is actuated by launch button 52 (seen in FIG. 2). Switch board 80 further supports a plurality of switches 70, 71, 72, 73, 74 and 75 which are positioned in alignment with buttons 60 through 65 (seen in FIG. 3). In addition, a plurality of circuit board conductive paths 109 provide interconnection between switches 70 through 75 as well as switch 81 and a multi-conductor flat cable 84. With temporary return to FIG. 2, it will be noted that flat cable 84 provides a plurality of electrical connections between switch board 80 and circuit board 110. Returning to FIG. 4, switch board 80 further supports a conductive pad 105 together with a trio of conductive pads 106, 107 and 108. Conductive pad 105 is maintained in contact with wiper contact 92 in all three detent positions of plate 90 described above in FIG. 3. Conversely, conductive pads 106, 107 and 108 correspond to the three detent positions also described above for launch control 50. Thus, as plate 90 (seen in FIG. 3) is moved pivotally between detent positions, a selected one of conductive pads 106 through 108 is brought into electrical connection to conductive pad 105 by the U-shaped structure of wiper contact 92. In this manner, a three condition signal set is provided to microprocessor 111 (seen in FIG. 2) for path selection in the above-described game play.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. An electronic tic-tac-toe game play apparatus comprising:

a housing defining an interior cavity;

a display, supported on said housing, defining a three row—three column matrix of squares and a trio of paths each joined to one of said columns and a game icon;

a microprocessor and memory for playing a tic-tac-toe game and for simulating a launch and travel of said game icon;

a launch control supported on said housing for selecting a path and launch power for said game icon and having a pivotable path selection ring, a launch button, a plate having a wiper contact and a switch board secured to said housing and supporting a plurality of conductive paths and a launch switch, said path selection ring, said launch button and said plate being pivotably movable upon said housing as a single assembly to select one of said paths and said launch button being depressible to close said switch and releasable after a player chosen interval to open said switch and thereby provides a launch power input signal to said microprocessor for simulated launch of said game icon along said selected one of said paths.

2. The electronic tic-tac-toe game play apparatus set forth in claim 1 wherein said launch control includes a return spring coupled to said launch button urging said launch button away from said switch.

3. The electronic tic-tac-toe game play apparatus set forth in claim 2 further including a three-position detent mechanism operative upon said launch control.

* * * * *